US008303360B2

(12) United States Patent
Kuriyagawa et al.

(10) Patent No.: US 8,303,360 B2
(45) Date of Patent: Nov. 6, 2012

(54) OUTBOARD MOTOR CONTROL APPARATUS

(75) Inventors: Koji Kuriyagawa, Saitama (JP); Hajime Yoshimura, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 296 days.

(21) Appl. No.: 12/760,261

(22) Filed: Apr. 14, 2010

(65) Prior Publication Data

US 2010/0267294 A1 Oct. 21, 2010

(30) Foreign Application Priority Data

Apr. 17, 2009 (JP) ..... 2009-101155

(51) Int. Cl.

| | |
|---|---|
| ***B63H 20/14*** | (2006.01) |
| ***B63H 23/00*** | (2006.01) |
| ***B63H 21/21*** | (2006.01) |
| ***B60W 10/04*** | (2006.01) |

(52) U.S. Cl. ..... 440/86; 440/84; 440/87; 440/1; 440/75

(58) Field of Classification Search ..... 440/1, 75, 440/84, 86; 123/376, 398; 447/166, 168, 447/169, 173, 174, 175, 176; 192/3.29, 3.3, 192/3.31; 701/67, 68

See application file for complete search history.

(56) References Cited

U.S. PATENT DOCUMENTS

| | | | | |
|---|---|---|---|---|
| 4,558,769 | A * | 12/1985 | Neisen | 192/3.31 |
| 5,095,776 | A * | 3/1992 | Sato | 477/38 |
| 5,336,120 | A * | 8/1994 | Maurer et al. | 440/84 |
| 5,754,969 | A * | 5/1998 | Ando et al. | 701/67 |
| 7,578,713 | B2 * | 8/2009 | Miyata et al. | 440/75 |

FOREIGN PATENT DOCUMENTS

JP 2007-315498 A 12/2007

* cited by examiner

*Primary Examiner* — Stephen Avila
*Assistant Examiner* — Anthony Wiest
(74) *Attorney, Agent, or Firm* — Carrier Blackman & Associates, P.C.; Joseph P. Carrier; William D. Blackman

(57) ABSTRACT

In an apparatus for controlling operation of an outboard motor mounted on a boat and having a torque converter equipped with a lockup clutch, it is configured to have a clutch controller that controls the lockup clutch to ON when a speed ratio of the torque converter is equal to or greater than a reference value, the clutch controller being configured to determine whether a throttle valve is at about a fully-opened position and to control the lockup clutch to ON when the speed ratio becomes equal to or greater than a predetermined value set smaller than the reference value before the speed ratio reaches the reference value, and the throttle valve is discriminated to be at about the fully-opened position. With this, it becomes possible to reliably make a lockup clutch ON when the acceleration is completed, so that the boat speed can reach the maximum speed.

4 Claims, 8 Drawing Sheets

OUTBOARD MOTOR CONTROL APPARATUS

BACKGROUND OF THE INVENTION

1. Field of the Invention

This invention relates to an outboard motor control apparatus, particularly to an apparatus for controlling an outboard motor having a torque converter.

2. Description of the Related Art

In recent years, there is proposed an outboard motor having a torque converter interposed between an internal combustion engine and drive shaft to amplify output torque of the engine and then transmit it to the drive shaft for enhancing acceleration performance, etc., as taught, for example, by Japanese Laid-Open Patent Application No. 2007-315498 ('498). In this conventional technique, the torque converter includes a lockup clutch.

SUMMARY OF THE INVENTION

The outboard motor having the torque converter as in the reference is configured so that, when a speed ratio of the torque converter is equal to or greater than a reference value and it is determined that the acceleration is completed, the lockup clutch is made ON (engaged) to prevent loss in transmittance of the engine output caused by slippage of the torque converter, thereby enabling the boat speed to reach the maximum speed.

In the case where such the outboard motor is clamped to a relatively large boat such as an offshore boat, depending on a wave and wind condition, the speed ratio of the torque converter may be saturated before becoming or exceeding the reference value and the acceleration is completed. Since the speed ratio does not become or exceed the reference value despite the fact that the acceleration is actually completed, the lockup clutch is not made ON. It disadvantageously hinders the boat speed from reaching the maximum speed.

An object of this invention is therefore to overcome the foregoing drawback by providing an apparatus for controlling an outboard motor having a torque converter, which apparatus can reliably make a lockup clutch ON when the acceleration is completed, so that the boat speed can reach the maximum speed.

In order to achieve the object, this invention provides in its first aspect an apparatus for controlling operation of an outboard motor mounted on a stern of a boat and having an internal combustion engine to power a propeller, a drive shaft connecting the engine and the propeller, and a torque converter equipped with a lockup clutch and interposed between the engine and the drive shaft, comprising: a speed ratio calculator that calculates a speed ratio of the torque converter based on an input rotation speed and output rotation speed of the torque converter; and a clutch controller that controls the lockup clutch to ON when the calculated speed ratio is equal to or greater than a reference value, wherein the clutch controller includes: a fully-opened throttle opening determiner that determines whether a throttle valve of the engine is at a fully-opened position or thereabout, and controls the lockup clutch to ON when the calculated speed ratio becomes equal to or greater than a predetermined value set smaller than the reference value before the calculated speed ratio reaches the reference value, and the throttle valve is discriminated to be at the fully-opened position or thereabout.

In order to achieve the object, this invention provides in its second aspect a method of controlling operation of an outboard motor mounted on a stern of a boat and having an internal combustion engine to power a propeller, a drive shaft connecting the engine and the propeller, and a torque converter equipped with a lockup clutch and interposed between the engine and the drive shaft, comprising steps of: calculating a speed ratio of the torque converter based on an input rotation speed and output rotation speed of the torque converter; and controlling the lockup clutch to ON when the calculated speed ratio is equal to or greater than a reference value, wherein the step of controlling includes: a step of determining whether a throttle valve of the engine is at a fully-opened position or thereabout, and controls the lockup clutch to ON when the calculated speed ratio becomes equal to or greater than a predetermined value set smaller than the reference value before the calculated speed ratio reaches the reference value, and the throttle valve is discriminated to be at the fully-opened position or thereabout.

BRIEF DESCRIPTION OF THE DRAWINGS

The above and other objects and advantages of the invention will be more apparent from the following description and drawings in which.

DETAILED DESCRIPTION OF THE PREFERRED EMBODIMENTS

Preferred embodiments of an outboard motor control apparatus according to the invention will now be explained with reference to the attached drawings.

Figure 1:
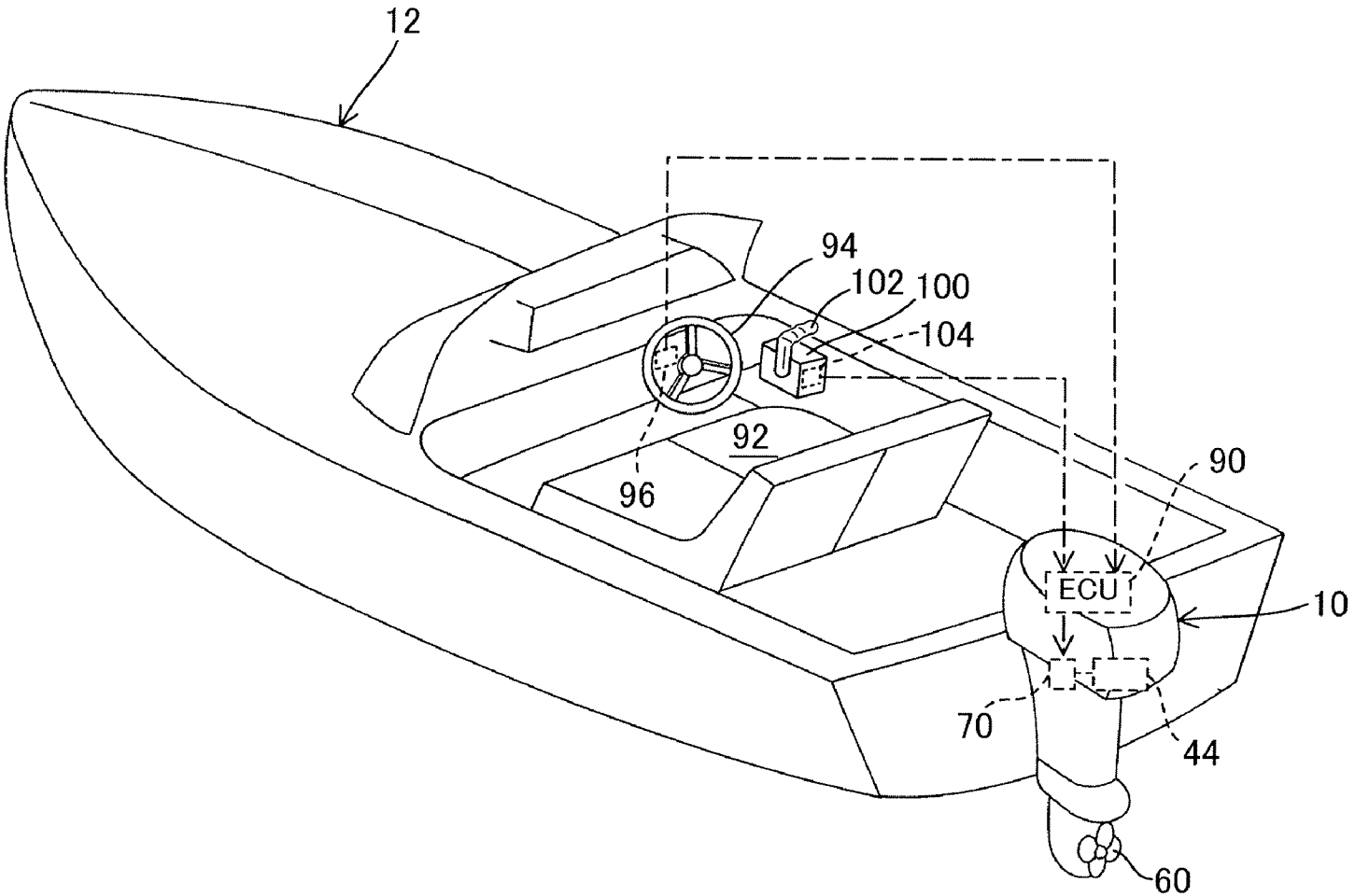
FIG. 1 is an overall schematic view of an outboard motor control apparatus including a boat (hull) according to a first embodiment of the invention.

FIG. 1 is an overall schematic view of an outboard motor control apparatus including a boat (hull) according to a first embodiment of the invention.

Figure 2:
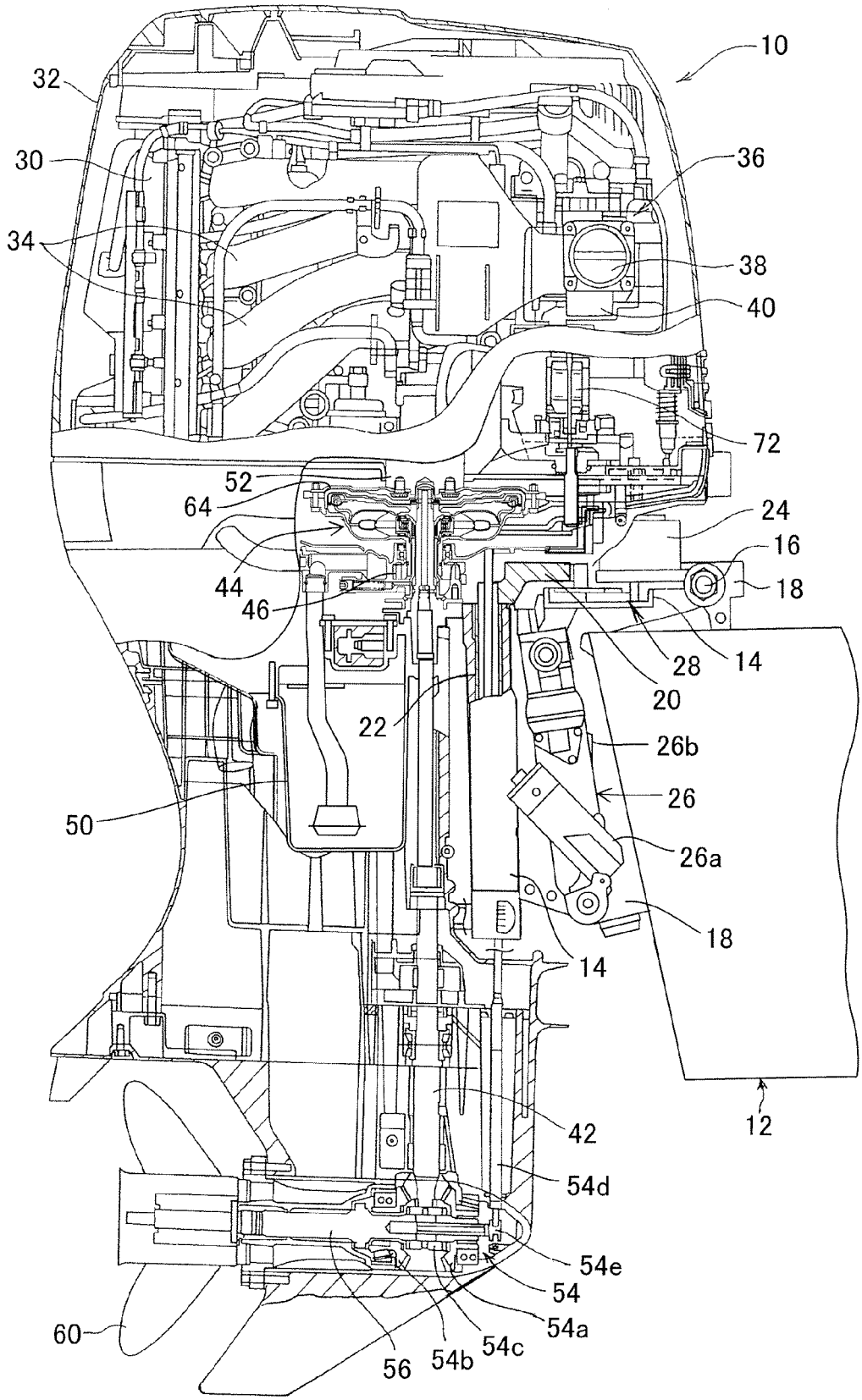
FIG. 2 is an enlarged sectional side view partially showing the outboard motor shown in FIG. 1.
Figure 3:
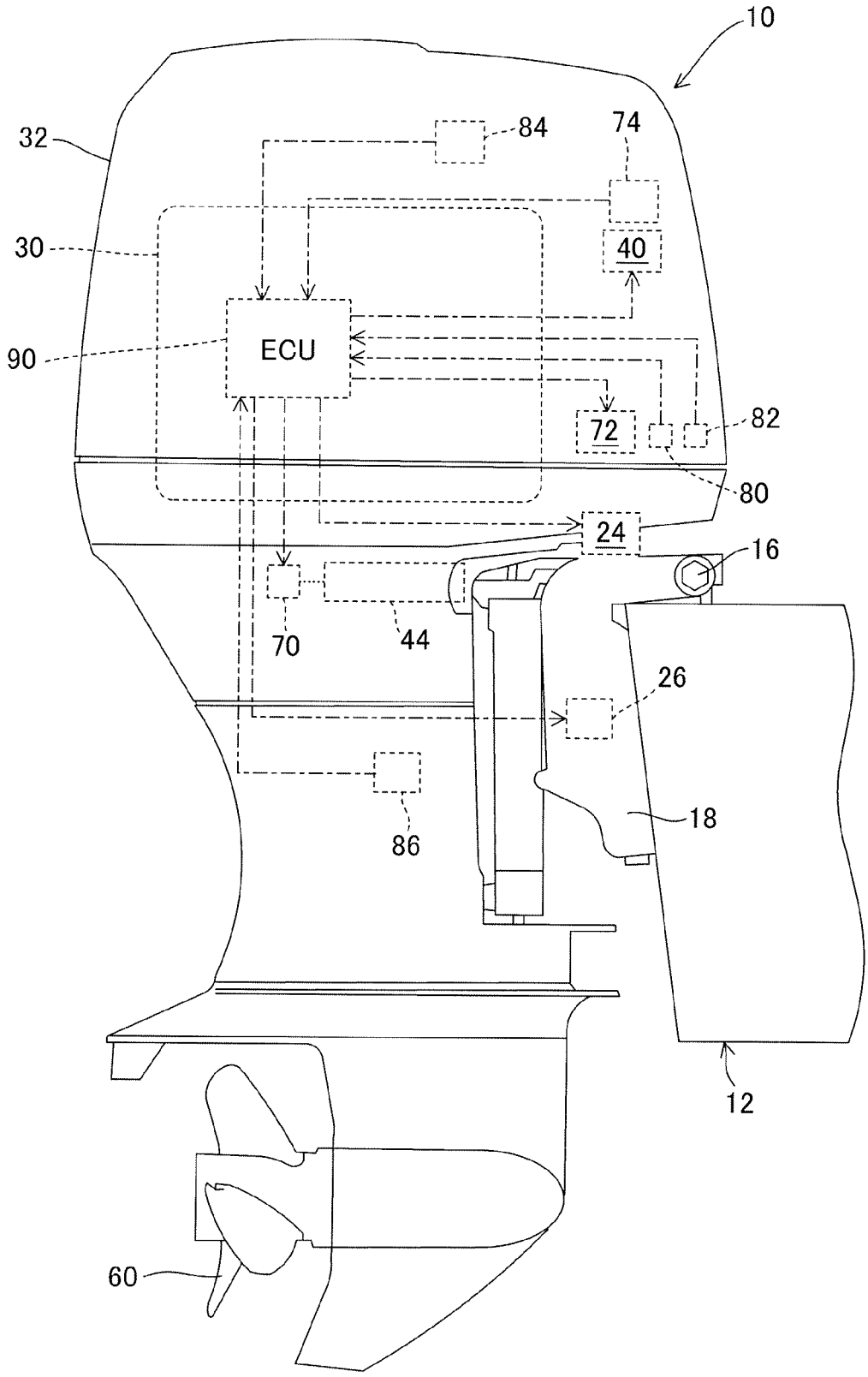
FIG. 3 is an enlarged side view of the outboard motor shown in FIG. 1.

FIG. 2 is an enlarged sectional side view partially showing the outboard motor shown in FIG. 1 and FIG. 3 is an enlarged side view of the outboard motor.

In FIGS. 1 to 3, a symbol 10 indicates an outboard motor. As illustrated, the outboard motor 10 is clamped (fastened) to the stern or transom of a boat (hull) 12.

As shown in FIG. 2, the outboard motor 10 is fastened to the boat 12 through a swivel case 14, tilting shaft 16 and stern brackets 18. The outboard motor 10 is equipped with a mount frame 20 and shaft 22. The shaft 22 is housed in the swivel case 14 to be rotatable about the vertical axis such that the outboard motor 10 can be rotated about the vertical axis relative to the boat 12. The mount frame 20 is fixed at its upper end and lower end to a frame (not shown) constituting a main body of the outboard motor 10.

An electric steering motor (actuator) 24 for operating the shaft 22 and a power tilt-trim unit 26 for regulating a tilt angle and trim angle of the outboard motor 10 are installed near the swivel case 14. A rotational output of the steering motor 24 is transmitted to the shaft 22 via a speed reduction gear mechanism 28 and the mount frame 20, whereby the outboard motor 10 is steered about the shaft 22 as a steering axis to the right and left directions (steered about the vertical axis).

The power tilt-trim unit 26 integrally comprises a hydraulic cylinder 26*a* for adjusting the tilt angle and a hydraulic cylinder 26*b* for adjusting the trim angle. When the hydraulic cylinders 26*a*, 26*b* are extended and contracted, the swivel case 14 is rotated about the tilting shaft 16 as a rotational axis, thereby tiling up/down and trimming up/down the outboard motor 10.

An internal combustion engine (hereinafter referred to as the "engine") 30 is disposed in the upper portion of the outboard motor 10. The engine 30 comprises a spark-ignition, water-cooling gasoline engine with a displacement of 2,200 cc. The engine 30 is located above the water surface and covered by an engine cover 32.

An intake pipe 34 of the engine 30 is connected to a throttle body 36. The throttle body 36 has a throttle valve 38 installed therein and an electric throttle motor (actuator) 40 for opening and closing the throttle valve 38 is integrally disposed thereto.

The output shaft of the throttle motor 40 is connected to the throttle valve 38 via a speed reduction gear mechanism (not shown). The throttle motor 40 is operated to open and close the throttle valve 38, thereby regulating the flow rate of the air sucked in the engine 30 to control the engine speed.

The outboard motor 10 further comprises a drive shaft (vertical shaft) 42 installed parallel to the vertical axis to be rotatably supported, a torque converter 44 interposed between the engine 30 and drive shaft 42, a hydraulic pump 46 that is attached to the drive shaft 42 and pumps operating oil to a lubricated portion of the engine 30, the torque converter 44 and the like, and a reservoir 50 for reserving the operating oil.

The upper end of the drive shaft 42 is connected to a crankshaft 52 of the engine 30 through the torque converter 44 and the lower end thereof is connected via a shift mechanism 54 with a propeller shaft 56 supported to be rotatable about the horizontal axis. One end of the propeller shaft 56 is attached with a propeller 60. Thus the drive shaft 42 connects the engine 30 with the propeller 60.

Figure 4:
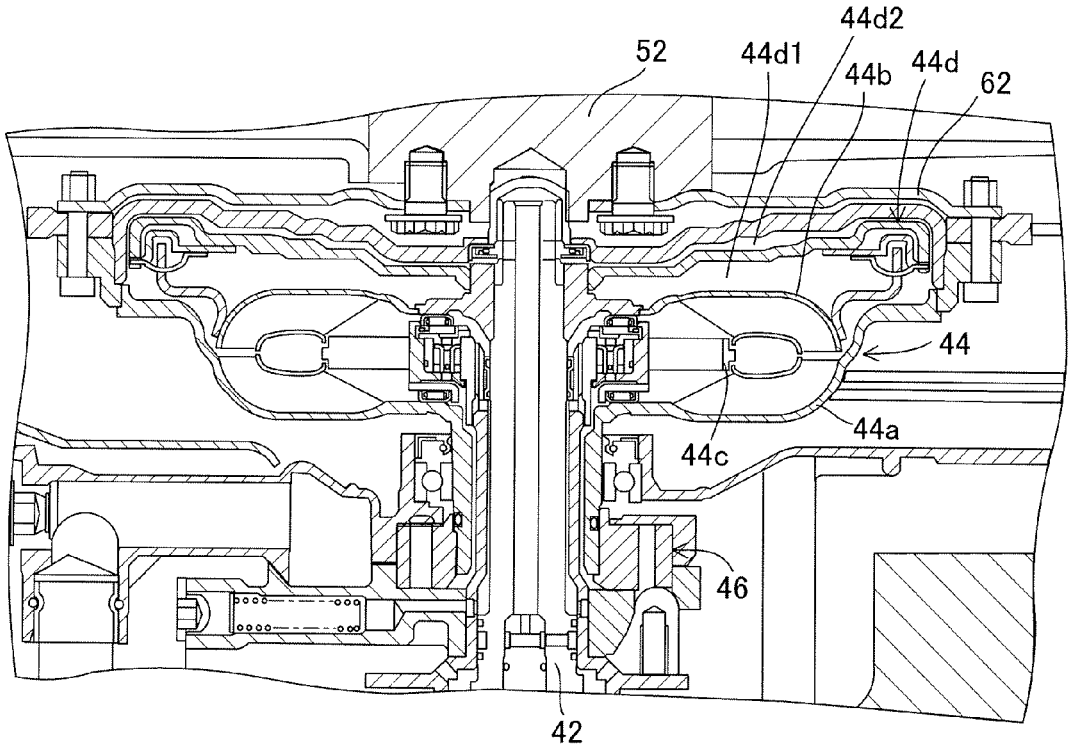
FIG. 4 is an enlarged sectional view showing a region around a torque converter shown in FIG. 2.

FIG. 4 is an enlarged sectional view showing a region around the torque converter 44 shown in FIG. 2.

As shown in FIG. 4, the torque converter 44 includes a pump impeller 44*a* connected to the crankshaft 52 through a drive plate 62, a turbine runner 44*b* that is installed to face the pump impeller 44*a* to receive/discharge the operating oil and connected to the drive shaft 42, a stator 44*c* installed between the pump impeller 44*a* and turbine runner 44*b*, a lockup clutch 44*d* and other components.

Figure 5:
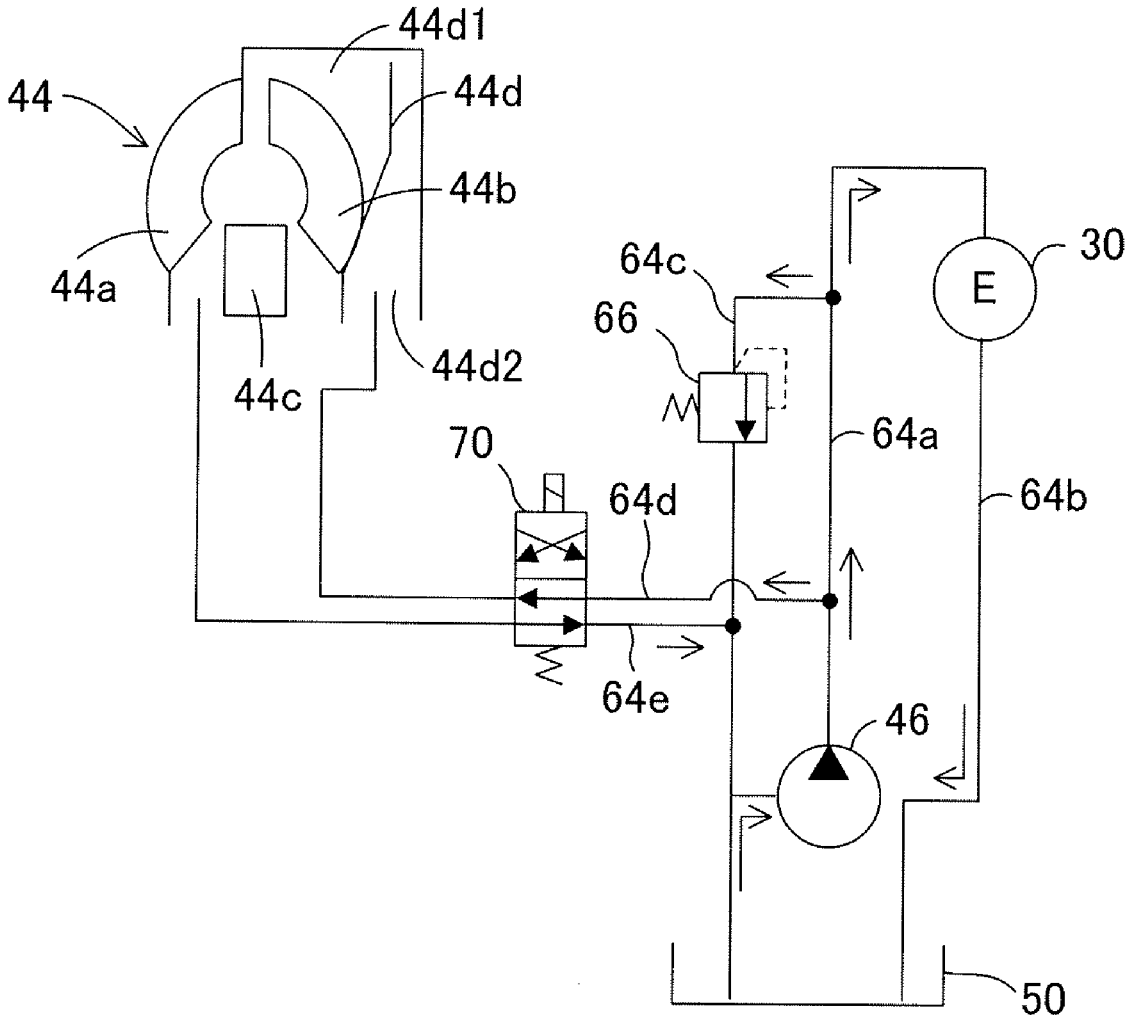
FIG. 5 is a hydraulic circuit diagram schematically showing the torque converter, a hydraulic pump and other components shown in FIG. 2.

FIG. 5 is a hydraulic circuit diagram schematically showing the torque converter 44, hydraulic pump 46, etc.

The hydraulic pump 46 driven by the engine 30 pumps up the operating oil in the reservoir 50 and forwards it to a first oil passage 64*a*. The pressurized operating oil forwarded to the first oil passage 64*a* is supplied to the lubricated portion of the engine 30 or the like and then returns to the reservoir 50 through a second oil passage 64*b*.

The first oil passage 64*a* is provided with a third oil passage 64*c* connecting the first oil passage 64*a* with an intake hole of the hydraulic pump 46. The third oil passage 64*c* is interposed with a relief valve 66 that opens when the pressure of the operating oil to be supplied to the engine 30 is at or above a defined value and closes when it is below the defined value.

A fourth oil passage 64*d* for circulating the operating oil to be supplied to the torque converter 44 is connected to the first oil passage 64*a* at a point between a discharge hole of the hydraulic pump 46 and a branch point of the first and third oil passages 64*a*, 64*c*. A fifth oil passage 64*e* for circulating the operating oil returning from the torque converter 44 to the hydraulic pump 46 is connected to the third oil passage 64*c* at a location downstream of the relief valve 66. The fourth and fifth oil passages 64*d*, 64*e* are installed with a lockup control valve 70 for controlling the operation of the lockup clutch 44*d*.

The lockup control valve 70 is a solenoid valve. The output of the valve 70 is connected to a piston chamber 44*d*1 of the lockup clutch 44*d* of the torque converter 44, and also connected to a chamber (rear chamber) 44*d*2 disposed in the rear of the piston chamber 44*d*1. The lockup control valve 70 switches the oil passage upon being magnetized/demagnetized, thereby controlling the ON/OFF state (engagement/release) of the lockup clutch 44*d*.

Specifically, when the lockup control valve 70 is magnetized, the operating oil is supplied to the piston chamber 44*d*1 and discharged from the rear chamber 44*d*2 so as to make the lockup clutch 44*d* ON (engaged), and when the valve 70 is demagnetized (the status in FIG. 5; initial condition), the operating oil is supplied to the rear chamber 44*d*2 and discharged from the piston chamber 44*d*1 so as to make the lockup clutch 44*d* OFF (released). Since the details of the aforementioned torque converter 44 is disclosed in '498, further explanation is omitted here.

The explanation of FIG. 2 will be resumed. The shift mechanism 54 comprises a forward bevel gear 54*a* and reverse bevel gear 54*b* which are connected to the drive shaft 42 to be rotated, a clutch 54*c* which can engage the propeller shaft 56 with either one of the forward bevel gear 54*a* and reverse bevel gear 54*b*, and other components.

The interior of the engine cover 32 is disposed with an electric shift motor (actuator) 72 that drives the shift mechanism 54. The output shaft of the shift motor 72 can be connected via a speed reduction gear mechanism (not shown) with the upper end of a shift rod 54*d* of the shift mechanism 54. When the shift motor 72 is operated, its output appropriately displaces the shift rod 54*d* and a shift slider 54*e* to move the clutch 54*c* to change the shift position among a forward position, reverse position and neutral position.

When the shift position is forward or reverse, the rotational output of the drive shaft 42 is transmitted via the shift mechanism 54 to the propeller shaft 56 to rotate the propeller 60 in one of the directions making the boat 12 move forward or rearward. The outboard motor 10 is equipped with a power source (not shown) such as a battery or the like attached to the engine 30 to supply operating power to the motors 24, 40, 72, etc.

As shown in FIG. 3, a throttle opening sensor 74 is installed near the throttle valve 38 and produces an output or signal indicative of opening of the throttle valve 38, i.e., throttle opening TH. A shift position sensor 80 installed near the shift rod 54*d* produces an output or signal corresponding to a shift position (neutral, forward or reverse) and a neutral switch 82 also installed near the shift rod 54*d* produces an ON signal when the shift position is neutral and an OFF signal when it is forward or reverse.

A crank angle sensor 84 is installed near the crankshaft 52 of the engine 30 and produces a pulse signal at every predetermined crank angle. A drive shaft rotation speed sensor 86 is installed near the drive shaft 42 and produces an output or signal indicative of rotation speed of the drive shaft 42.

The outputs of the foregoing sensors and switch are sent to an electronic control unit (ECU) 90 disposed in the outboard motor 10. The ECU 90 which has a microcomputer including a CPU, ROM, RAM and other devices is installed in the engine cover 32 of the outboard motor 10.

As shown in FIG. 1, a steering wheel 94 is installed near a cockpit (the operator's seat) 92 of the boat 12 to be manipulated or rotated by the operator. A steering angle sensor 96 installed near a shaft (not shown) of the steering wheel 94 produces an output or signal corresponding to the steering angle applied or inputted by the operator through the steering wheel 94.

A remote control box 100 provided near the cockpit 92 is equipped with a shift/throttle lever 102 installed to be manipulated by the operator. Upon the manipulation, the lever 102 can be swung in the front-back direction from the initial position and is used by the operator to input a shift position change command and engine speed regulation command. A lever position sensor 104 is installed in the remote control box 100 and produces an output or signal corresponding to a position of the lever 102. The outputs of the steering angle sensor 96 and lever position sensor 104 are also sent to the ECU 90.

Based on the inputted outputs, the ECU 90 controls the operations of the motors and ON/OFF state of the lockup clutch 44*d* of the torque converter 44.

Figure 6:
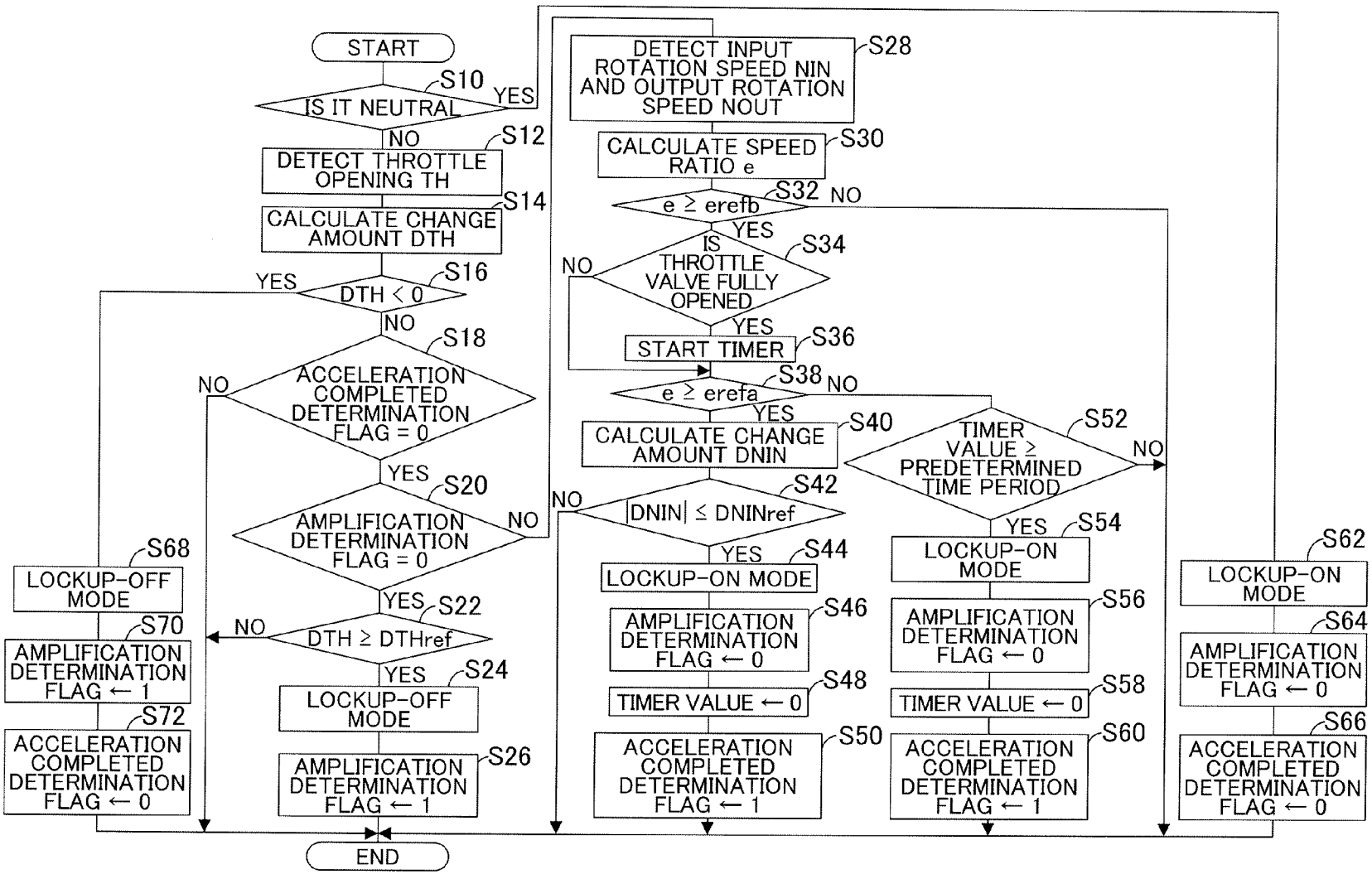
FIG. 6 is a flowchart showing the control of an electronic control unit shown in FIG. 1.

FIG. 6 is a flowchart showing the control of the ECU 90. The illustrated program is executed by the ECU 90 at predetermined interval, e.g., 100 milliseconds.

The program begins in S10, in which it is determined whether the shift position is neutral. This determination is made by checking as to whether the neutral switch 82 outputs the ON signal. When the result in S10 is negative, i.e., it is determined to be in gear, the program proceeds to S12, in which the throttle opening TH is detected or calculated from the output of the throttle opening sensor 74 and to S14, in which a change amount (variation) DTH of the detected throttle opening TH per a unit time (e.g., 500 milliseconds) is calculated.

The program proceeds to S16, in which it is determined whether the throttle valve 38 is operated in the closing direction, i.e., the boat 12 is in a condition to be decelerated (hereinafter called "decelerating condition"). This determination is made by checking as to whether the change amount DTH of the throttle opening TH is less than 0 degree. Specifically, when the change amount DTH is a negative value, the throttle valve 38 is determined to be operated in the closing direction (the boat 12 is in the decelerating condition) and when the change amount DTH is 0 or a positive value, the throttle valve 38 is determined to be stopped or operated in the opening direction (the boat 12 is operated to cruise at a constant speed or accelerate).

When the result in S16 is negative, the program proceeds to S18, in which it is determined whether a bit of an acceleration completed determination flag of the torque converter 44 (torque converter acceleration completed determination flag; explained later) is 0. Since the initial value of a bit of this flag is 0, the result in S18 in the first program loop is generally affirmative and the program proceeds to S20, in which it is determined whether a bit of an amplification determination flag of the torque converter 44 (torque converter amplification determination flag) is 0.

As explained below, a bit of the amplification determination flag is set to 1 when a condition where the output torque of the engine 30 is amplified through the torque converter 44 and transmitted to the drive shaft 42 (i.e., where the operation of the outboard motor 10 is in a range (torque amplification range) that the torque is to be amplified by the torque converter 44 to accelerate the boat 12) is established, and reset to 0 when the output torque of the engine 30 is not amplified (i.e., the operation of the outboard motor 10 is out of the torque amplification range).

Since the initial value of a bit of the amplification determination flag is also 0, the result in S20 in the first program loop is generally affirmative and the program proceeds to S22, in which it is determined whether the throttle valve 38 is operated in the opening direction, i.e., the boat 12 is in a condition to be accelerated (hereinafter called "accelerating condition"). Specifically, the calculated change amount DTH of the throttle opening TH is compared with a throttle predetermined value (threshold value) DTHref and, when the change amount DTH is equal to or greater than the predetermined value DTHref, the throttle valve 38 is determined to be operated in the opening direction (the boat 12 is in the accelerating condition). The throttle predetermined value DTHref is set to a value (e.g., 0.5 degree) enabling to determine whether the boat 12 is in the accelerating condition. When the result in S22 is negative, i.e., when the boat 12 is determined to be neither decelerated nor accelerated but is operated to cruise at a constant speed, the remaining steps are skipped and when the result is affirmative, the program proceeds to S24, in which the torque converter 44 is controlled with a lockup-OFF mode. The operation in the lockup-OFF mode is to demagnetize the lockup control valve 70 and make the lockup clutch 44*d* of the torque converter 44 OFF. As a result, the output torque of the engine 30 is amplified through the torque converter 44 and transmitted to the drive shaft 42, thereby improving acceleration performance. Next, in S26, a bit of the torque converter amplification determination flag is set to 1 and the present program loop is terminated. When the bit of this flag is set to 1, since it means that the outboard motor 10 is in a condition that the output torque of the engine 30 is amplified by the torque converter 44 to accelerate the boat 12, the result in S20 in the next and subsequent loops is negative and the program proceeds to S28.

In S28, an input rotation speed NIN and output rotation speed NOUT of the torque converter 44 are detected or calculated. Since the input side of the torque converter 44 is connected to the crankshaft 52 of the engine 30, the input rotation speed NIN is identical with the engine speed and therefore can be detected by counting the output pulses of the crank angle sensor 84. The output rotation speed NOUT is detected from the output of the drive shaft rotation speed sensor 86.

The program proceeds to S30, in which a speed ratio e of the torque converter 44 is calculated based on the input rotation speed NIN and output rotation speed NOUT. The speed ratio e is obtained by dividing the output rotation speed NOUT by the input rotation speed NIN as shown in the following equation.

$$\text{Speed ratio } e = (\text{Output rotation speed } NOUT)/(\text{Input rotation speed } NIN)$$

The program proceeds to S32, in which it is determined whether the calculated speed ratio e is equal to or greater than a predetermined value erefb (e.g., 0.6) set smaller than a reference value erefa which is a threshold value used to determine whether to make the lockup clutch 44*d* ON. When the result in S32 is negative, the remaining steps are skipped and when the result is affirmative, the program proceeds to S34, in which, based on the output of the throttle opening sensor 74, it is determined whether the throttle valve 38 is at the fully-opened position or thereabout, i.e., the throttle opening TH is about 90 degrees.

When the result in S34 is affirmative, the program proceeds to S36, in which a timer (up counter) used for measuring a time period of the operation of the engine 30 with the throttle valve 38 positioned at about the fully-opened position, is started. When, following the affirmative result in S34, the program proceeds to S36 in the next and subsequent loops, since the timer was already started, the timer value is updated and the time measurement is continued. When the result in S34 is negative, the processing of S36 is skipped.

Next, in S38, it is determined whether the speed ratio e of the torque converter 44 is equal to or greater than the reference value erefa. The reference value erefa is set to a value (e.g., 0.7) enabling to determine whether the torque amplification range has ended, i.e., whether the torque amplification range (acceleration range) has been saturated and the acceleration has been completed.

When the result in S38 is affirmative, i.e., when it is determined that the acceleration has been completed, the program proceeds to S40, in which a change amount DNIN of the input rotation speed NIN (i.e., a change amount (variation) of the engine speed) is calculated. The change amount DNIN is obtained by subtracting the input rotation speed NIN detected in the present program loop from that detected in the previous program loop.

The program proceeds to S42, in which it is determined whether the speed of the boat 12 remains stable at the maximum speed or thereabout after the acceleration is completed. This determination is made by comparing an absolute value of the calculated change amount DNIN with a prescribed value (threshold value) DNINref. When the absolute value is equal to or less than the prescribed value DNINref, it is determined that the boat speed is stable at the maximum value or thereabout. The prescribed value DNINref is set to a value (e.g., 500 rpm) enabling to determine whether the speed of the boat 12 remains stable at about the maximum value after the acceleration is completed, in other words, the change amount DNIN is relatively small.

When the result in S42 is negative, it is determined that the boat speed is not stable at about the maximum speed and the remaining steps are skipped. When the result is affirmative, the program proceeds to S44, in which the torque converter 44 is controlled with a lockup-ON mode. The operation of the lockup-ON mode is to magnetize the lockup control valve 70 and make the lockup clutch 44*d* ON. Since this establishes the direct connection between the crankshaft 52 of the engine 30 and the drive shaft 42, slippage of the torque converter 44 can be prevented so that the speed of the boat 12 reaches the maximum speed (in a range of the engine performance), thereby improving speed performance.

Thus, when the speed ratio e is equal to or greater than the reference value erefa and the absolute value of the change amount DNIN is equal to or less than the prescribed value DNINref, the lockup clutch 44*d* of the torque converter 44 is made ON. After the step of S44, in S46, a bit of the torque converter amplification determination flag is reset to 0 and in S48, the timer value is reset to 0.

In S50, a bit of the torque converter acceleration completed determination flag is set to 1. As is clear from above, this flag is set to 1 when the acceleration through torque amplification by the torque converter 44 is completed and the lockup clutch 44*d* is made ON, and in the other cases, reset to 0, as described later.

When the result in S38 is negative, i.e., when the speed ratio e is equal to or greater than the predetermined value erefb and less than the reference value erefa, the program proceeds to S52, in which it is determined whether a discrimination that the throttle valve 38 is at about the fully-opened position is made continuously for a predetermined time period. This determination is made by checking as to whether the timer value is equal to or greater than the predetermined time period (e.g., 10 seconds).

When the result in S52 is negative, the remaining steps are skipped and, when the result is affirmative, the program proceeds to S54, in which the torque converter 44 is controlled with the lockup-ON mode to make the lockup clutch 44*d* ON.

Thus when, before becoming or exceeding the reference value erefa, the speed ratio e of the torque converter 44 is equal to or greater than the predetermined value erefb, the discrimination that the throttle valve 38 is at about the fully-opened position is made, and the predetermined time period elapses after the discrimination is made, it is determined that the acceleration has been completed and the program proceeds to S54 as mentioned above.

In S56, a bit of the torque converter amplification determination flag is reset to 0, in S58, the timer value is reset to 0 and in S60, a bit of the torque converter acceleration completed determination flag is set to 1. When the acceleration completed determination flag is set to 1 in S60 or S50 described above, the result in S18 in the next and subsequent loops is negative and the processing of S20 to S60 is skipped.

When the result in S10 is affirmative, i.e., when the shift position is neutral, the program proceeds to S62, in which the torque converter 44 is controlled with the lockup-ON mode, to S64, in which a bit of the amplification determination flag is reset to 0 and then to S66, in which a bit of the acceleration completed determination flag is reset to 0.

When the result in S16 is affirmative, i.e., when the boat 12 is in the decelerating condition, the program proceeds to S68, in which the torque converter 44 is controlled with the lockup-OFF mode, to S70, in which a bit of the amplification determination flag is set to 1, to S72, in which a bit of the acceleration completed determination flag is reset to 0 and then the program is terminated.

Figure 7:
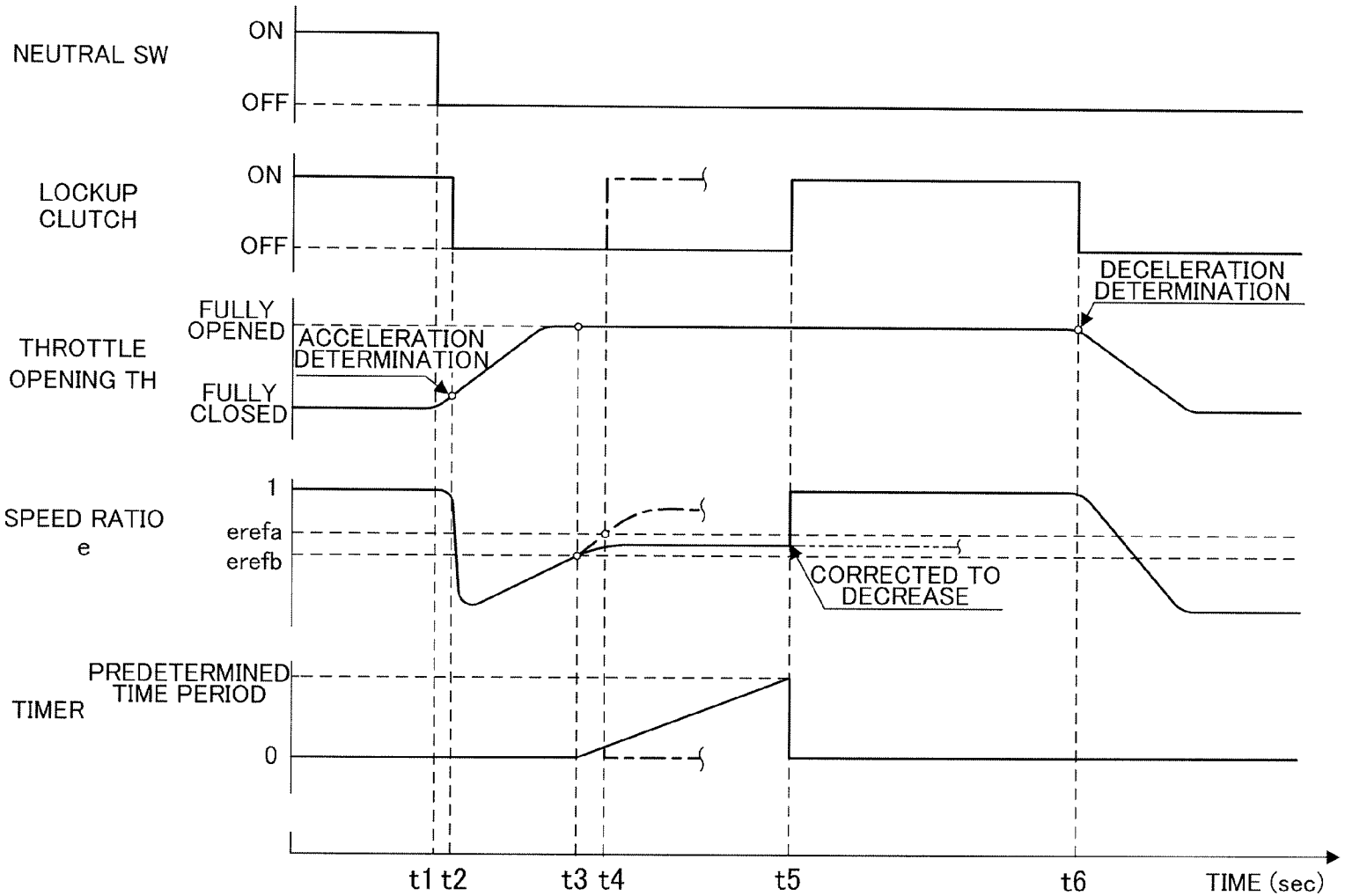
FIG. 7 is a time chart for explaining the process of the FIG. 6 flowchart.

FIG. 7 is a time chart for explaining the process of the FIG. 6 flowchart.

As shown in FIG. 7, at the time t1, the shift position is changed from neutral to any in-gear position upon the manipulation of the shift/throttle lever 102 by the operator (S10). When the throttle valve 38 is gradually opened and the boat 12 is determined to be in the accelerating condition at the time t2, the lockup clutch 44*d* is made OFF (S22, S24).

When, at the time t3, it is determined that the speed ratio e is equal to or greater than the predetermined value erefb and the throttle valve 38 is at about the fully-opened position, the timer is started (S32 to S36).

If the speed ratio e is further increased to a value at or above the reference value erefa (at the time t4) as indicated by long and short dashed lines, the lockup clutch 44*d* is made ON, while the timer value is reset (S38 to S48).

On the other hand, if the speed ratio e is saturated before becoming or exceeding the reference value erefa as indicated by solid lines from the time t3 to the time t5, the lockup clutch 44*d* is forcibly made ON at the time t5 at which the predetermined time period elapses from the time t3 (that is when the throttle valve 38 is determined to be at about the fully-opened position) i.e., at which the timer value is equal to or greater than the predetermined time period (S52, S54). Also, the timer value is reset at the time t5 (S58).

When the throttle valve 38 is gradually closed upon the manipulation of the shift/throttle lever 102 by the operator and it is determined that the boat 12 is in the decelerating condition at the time t6, the lockup clutch 44*d* is made OFF (S16, S68).

Thus, the outboard motor control apparatus according to the first embodiment is configured such that, when the speed ratio e of the torque converter 44 calculated from the input rotation speed NIN and output rotation speed NOUT is equal to or greater than the reference value erefa, the lockup clutch 44*d* is made ON (engaged), while when, before becoming or exceeding the reference value erefa, the speed ratio e is equal to or greater than the predetermined value erefb set smaller than the reference value erefa, the discrimination that the throttle valve 38 is at about the fully-opened position is made, and the predetermined time period elapses from the time t3 at which the discrimination is made, the lockup clutch 44*d* is made ON. With this, even when the speed ratio e of the torque converter 44 is saturated before becoming or exceeding the reference value erefa, it becomes possible to determine that the acceleration is completed at the time when the predetermined time period elapses and reliably make the lockup clutch 44*d* ON, thereby enabling the boat speed to reach the maximum speed.

Further, it is configured such that, when the speed ratio e is equal to or greater than the reference value erefa, the lockup clutch 44*d* is made ON. With this, it becomes possible to accurately detect the time when the acceleration is completed, and since the lockup clutch 44*d* is made ON upon the completion of acceleration, speed performance can be enhanced. Further, slippage of the torque converter 44 can be prevented by making the lockup clutch 44*d* ON, thereby avoiding fuel efficiency from deteriorating.

Next, an outboard motor control apparatus according to a second embodiment will be explained.

The explanation will be made with focus on points of difference from the first embodiment. In the second embodiment, when the lockup clutch 44*d* is made ON before the speed ratio e of the torque converter 44 becomes or exceeds the reference value erefa, the reference value erefa is corrected to decrease.

Figure 8:
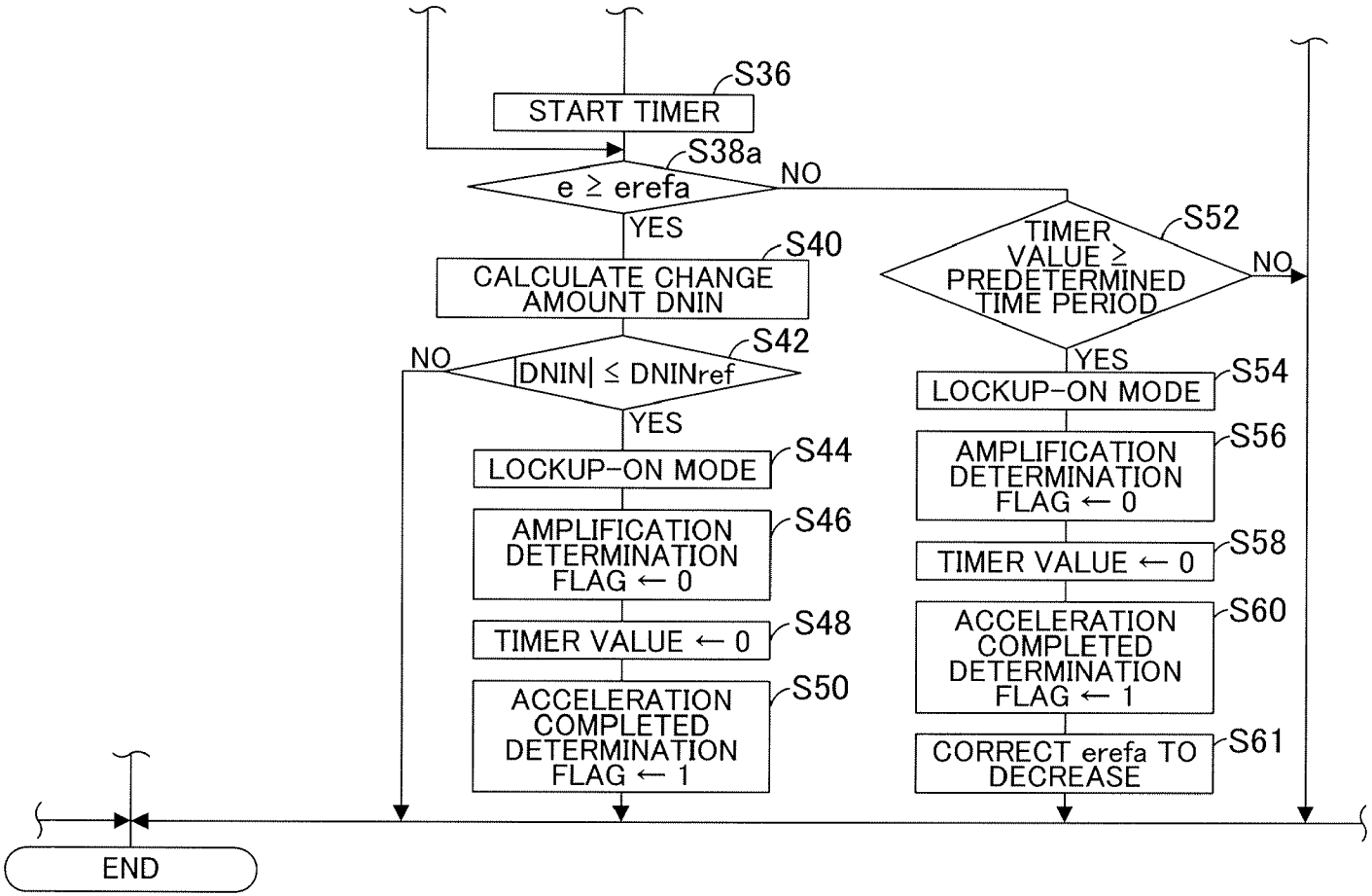
FIG. 8 is a flowchart showing the control of an electric control unit of an outboard motor control apparatus according to a second embodiment of the invention, with focus on difference from the FIG. 6 flowchart.

FIG. 8 is a flowchart showing the control of the ECU 90 of the outboard motor control apparatus according to the second embodiment, with focus on difference from the FIG. 6 flowchart of the first embodiment. The steps corresponding to those of the FIG. 6 flowchart are assigned by the same reference numbers.

After the processing of S10 to S36 the same as in the first embodiment, in S38*a*, it is determined whether the speed ratio e of the torque converter 44 is equal to or greater than the reference value erefa. When the processing of S38*a* is conducted for the first time, similarly to the first embodiment, the reference value erefa is set to a value (e.g., 0.7) enabling to determine whether the torque amplification range has ended. After that, however, the reference value erefa is appropriately corrected in accordance with the operating condition of the outboard motor 10, which will be explained later.

When the result in S38*a* is negative, the program proceeds to S52. When the result in S52 is affirmative and the program proceeds to S54, more exactly, when the lockup clutch 44*d* is made ON before the speed ratio e becomes equal to or greater than the reference value erefa, following the processing of S56 to S60, the program proceeds to S61, in which the reference value erefa is corrected to decrease, i.e., it is corrected by subtracting a predetermined value (e.g., 0.03) from the current value, whereafter the program is terminated.

In the step of S38*a* in the next program loop, the speed ratio e is compared to the reference value erefa thus corrected to decrease. In the case where the program proceeds to S61 again after correcting the reference value erefa to decrease, the decreased reference value erefa is further corrected by subtracting the predetermined value from the current value.

The remaining configuration is the same as that in the first embodiment and will not be explained.

Thus, the outboard motor control apparatus according to the second embodiment is configured such that, if the lockup clutch 44*d* is made ON when the speed ratio e is saturated before becoming or exceeding the reference value erefa and the predetermined time period elapses after the discrimination that the throttle valve 38 is at about the fully-opened position is made, as indicated by imaginary lines at the time t5 in FIG. 7, the reference value erefa is corrected to decrease using the learning control. With this, when the next operation of the lockup clutch 44*d* is controlled, since the speed ratio e of the torque converter 44 is compared to the reference value erefa thus corrected to decrease, the speed ratio e is not easily saturated before becoming or exceeding the reference value erefa, thereby enabling to make the lockup clutch 44*d* ON at the appropriate timing, i.e., when the acceleration is completed.

As stated above, in the first and second embodiments, it is configured to have an apparatus for and a method of controlling operation of an outboard motor (10) mounted on a stern of a boat (12) and having an internal combustion engine (30) to power a propeller (60), a drive shaft (42) connecting the engine and the propeller, and a torque converter (44) equipped with a lockup clutch (44*d*) and interposed between the engine and the drive shaft, comprising: a speed ratio calculator (ECU 90, S38, S44) that calculates a speed ratio (e) of the torque converter based on an input rotation speed (NIN) and output rotation speed (NOUT) of the torque converter; and a clutch controller (ECU 90, S38, S44) that controls the lockup clutch to ON when the calculated speed ratio is equal to or greater than a reference value (erefa), wherein the clutch controller includes: a fully-opened throttle opening determiner (ECU 90, S34) that determines whether a throttle valve (38) of the engine is at a fully-opened position or thereabout, and controls the lockup clutch to ON when the calculated speed ratio becomes equal to or greater than a predetermined value (erefb) set smaller than the reference value before the calculated speed ratio reaches the reference value, and the throttle valve is discriminated to be at the fully-opened position or thereabout (S32 to S38, S54).

With this, even when the speed ratio e of the torque converter 44 is saturated before the speed ratio reaches the reference value erefa, it becomes possible to determine that the acceleration is completed based on the throttle opening and reliably make the lockup clutch 44*d* ON, thereby enabling the boat speed to reach the maximum speed.

In the apparatus and method, the fully-opened throttle opening determiner controls the lockup clutch to ON when a predetermined time period has elapsed since the discrimination (S52, S54). With this, it becomes possible to determine that the acceleration is completed at the time when the predetermined time period has elapsed and further reliably make the lockup clutch 44*d* ON.

In the apparatus and method according to the second embodiment, the clutch controller corrects the reference value to decrease when the lockup clutch is made ON before the calculated speed ratio reaches the reference value. With this, in addition to the above effects, when the next operation of the lockup clutch 44*d* is controlled, since the speed ratio e of the torque converter 44 is compared to the reference value erefa thus corrected to decrease, the speed ratio e is not easily saturated before reaching the reference value erefa, thereby enabling to make the lockup clutch 44*d* ON at the appropriate timing that the acceleration is completed.

It should be noted that, although the reference value erefa, predetermined values erefb, displacement of the engine 30 and other values are indicated with specific values in the foregoing, they are only examples and not limited thereto.

Japanese Patent Application No. 2009-101155 filed on Apr. 17, 2009 is incorporated by reference herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An apparatus for controlling operation of an outboard motor mounted on a stern of a boat and having an internal combustion engine to power a propeller, a drive shaft connecting the engine and the propeller, and a torque converter equipped with a lockup clutch and interposed between the engine and the drive shaft, comprising:

a speed ratio calculator that calculates a speed ratio of the torque converter based on an input rotation speed and output rotation speed of the torque converter; and a clutch controller that controls the lockup clutch to ON when the calculated speed ratio is equal to or greater than a reference value, wherein the clutch controller includes:

a fully-opened throttle opening determiner that determines whether a throttle valve of the engine is at a fully-opened position or thereabout, and controls the lockup clutch to ON when the calculated speed ratio becomes equal to or greater than a predetermined value set smaller than the reference value before the calculated speed ratio reaches the reference value, and the throttle valve is discriminated to be at the fully-opened position or thereabout, wherein the clutch controller corrects the reference value to decrease when the lockup clutch is made ON before the calculated speed ratio reaches the reference value.

2. The apparatus according to claim 1, wherein the fully-opened throttle opening determiner controls the lockup clutch to ON when a predetermined time period has elapsed since the discrimination.

3. A method of controlling operation of an outboard motor mounted on a stern of a boat and having an internal combustion engine to power a propeller, a drive shaft connecting the engine and the propeller, and a torque converter equipped with a lockup clutch and interposed between the engine and the drive shaft, comprising steps of:

calculating a speed ratio of the torque converter based on an input rotation speed and output rotation speed of the torque converter; and controlling the lockup clutch to ON when the calculated speed ratio is equal to or greater than a reference value, wherein the step of controlling includes:

a step of determining whether a throttle valve of the engine is at a fully-opened position or thereabout, controlling the lockup clutch to ON when the calculated speed ratio becomes equal to or greater than a predetermined value set smaller than the reference value before the calculated speed ratio reaches the reference value, and the throttle valve is discriminated to be at the fully-opened position or thereabout, and correcting the reference value to decrease when the lockup clutch is made ON before the calculated speed ratio reaches the reference value.

4. The method according to claim 3, wherein the step of determining controls the lockup clutch to ON when a predetermined time period has elapsed since the discrimination.

* * * * *